United States Patent [19]

Neff

[11] Patent Number: 5,070,952

[45] Date of Patent: Dec. 10, 1991

[54] DOWNHOLE MILLING TOOL AND CUTTER THEREFORE

[75] Inventor: Michael C. Neff, Aberdeen, Scotland

[73] Assignee: Smith International, Inc., Houston, Tex.

[21] Appl. No.: 445,823

[22] Filed: Nov. 28, 1989

[30] Foreign Application Priority Data

Feb. 24, 1989 [GB] United Kingdom ..... 8904251

[51] Int. Cl.[5] ..... E21C 13/00

[52] U.S. Cl. ..... 175/410; 166/55.7; 408/224

[58] Field of Search ..... 166/55, 55.6, 55.7, 166/55.8; 175/379, 409, 410, 411, 412; 30/103-105; 72/117, 120; 83/178, 180; 51/72 R, 109 R; 407/34, 53, 54; 408/200, 203.5, 223, 224, 227

[56] References Cited

U.S. PATENT DOCUMENTS

| | | | |
|---|---|---|---|
| 1,827,511 | 10/1931 | Evans | 408/227 |
| 2,290,595 | 7/1942 | Kinnear | 175/379 |
| 2,846,193 | 8/1958 | Chadderdon | 166/55.7 |
| 2,859,943 | 11/1958 | Chadderdon | 166/55.8 |
| 3,106,973 | 10/1963 | Christensen | 175/410 |
| 3,726,351 | 4/1973 | Williams, Jr. | 175/410 |
| 4,115,024 | 9/1978 | Sussmuth | 407/54 |
| 4,655,648 | 4/1987 | Hellbergh | 408/224 |
| 4,710,074 | 12/1987 | Springer | 408/200 |
| 4,872,520 | 10/1989 | Nelson | 175/410 |

*Primary Examiner*—William P. Neuder

*Attorney, Agent, or Firm*—Robert G. Upton

[57] ABSTRACT

A cutter for a downhole milling or cutting tool and a tool incorporating the blade has a longitudinal axis about which the tool is rotatable. The tool may have a plurality of circumferentially disposed blades which are either fixed or radially movable to perform a cutting operation. Each of the cutters has a blade having a cutting surface which is formed by a plurality of cutting elements. Each of the cutting elements has a cutting edge and a plurality of protruding ridges each of which are longitudinally spaced from one another and interspaced from one another by a recess portion so that in use swarf moves upwardly from a first cutting edge along the recess portion and is broken off when approaching the next, uppermost, ridge. By providing such relatively closely spaced ridges generally C-shaped swarf cuttings are produced and "birdnesting" is substantially reduced or eliminated. The cutting elements each have a cutting surface which presents a negative radial rake angle.

15 Claims, 5 Drawing Sheets

DOWNHOLE MILLING TOOL AND CUTTER THEREFORE

BACKGROUND OF THE INVENTION

I. Field of the Invention

This invention relates to a downhole milling tool and to a cutter therefore cutting tubular members downhole.

II. Description of the Prior Art

Downhole milling tools are well known and may consist of a tubular body having an axial aperture therethrough for circulation of cooling fluid and a plurality of equi-circumferentially disposed slots in the outer surface of the body. In each of the slots is located a pivotally mounted cutting blade and a means is provided for moving each of the cutting blades radially outwardly from the body. Each of the cutting blades has an outer surface facing the direction of rotation of the tool which is dressed with a cutting material. The dressing may be formed by crushed tungsten carbide chips which are randomly dispersed on the blade surface. The problem associated with crushed tungsten carbide chips is that because they have an irregular shape and size they are difficult to secure to the blade surface and such inconsistency in shape also leads to unpredictable performance in respect of swarf cutting configuration and rate of penetration. This problem has been alleviated by using tungsten carbide elements having a circular or rectangular cross-section, the tungsten carbide elements being brazed, soldered or welded to the blade. It has been found, with advantage, that if tungsten carbide elements of regular shape are used then they may be located on the blade both radially and in an axial longitudinal direction of the blade in a regular formation such that each element provides a negative rake angle, that is, in use each blade is angled downwardly and rearwardly with respect to the vertical direction of the blade taken in the direction of rotation when in use.

The known cutting elements of regular shape have been known to be provided with a protruding ridge or chip breaker, that is a projection which limits the length of swarf cut by the cutting edge of the element. However such known elements have only one chip breaker and once that is worn off the performance of the tool deteriorates until the next element with a new chip breaker is exposed.

It will be understood that the provision of a chip breaker is extremely desirable to overcome the phenomenon known as "birdnesting", that is long spirals of swarf that are cut from a tubular member being machined forming into a conglomerate mass which restricts the flow of mud about a tool and reduces the rate of penetration of the tool. It is therefore an object of this invention to provide a milling tool and a cutter therefore in which the foregoing problems are substantially mitigated.

SUMMARY OF THE INVENTION

According to one aspect of this invention there is provided a cutter for a downhole milling tool which tool is rotatable about a longitudinal axis, said cutter comprising a blade having a cutting surface, said cutting surface being formed by a plurality of cutting elements, each cutting element having a cutting edge and plurality of protruding ridges each being longitudinally axially spaced from one another and interspaced by a recessed portion, whereby in use swarf moves upwardly from the cutting edge along said recessed portion and is broken off. Generally c-shaped swarf cuttings are thus preferably produced.

In a preferred embodiment the cutting surface extends in a generally radial direction across the intended direction of rotation of the tool and the cutting edges also extend generally radially.

Conveniently each cutting element is a discrete part, each of which is secured to the cutting blade by, for example, brazing or soldering or welding.

Advantageously the cutting elements of odd numbered rows extending longitudinally are in line and even numbered rows extending longitudinally are in line and the even numbered rows are offset in a radial direction by about half the radial length of a cutting element from the odd numbered rows.

Advantageously each cutting element is arranged to produce a negative axial rake angle with respect to the plane of the longitudinal axis, which angle may be in the range 1–20 degrees and preferably in the range 7–10 degrees.

Preferably each of the cutting elements is secured over a planar leading surface of the blade and each element has a front cutting face which is inclined with respect to the rear surface thereof, said rear surface abutting the blade so that the front cutting surface is provided with said negative axial rake angle. Alternatively each cutting element has parallel front and rear faces and the leading face of the blade has a generally radial slot formed therein which is inclined in the longitudinal axial direction to present the front face of the cutting element with a negative axial rake angle. In another alternative arrangement each cutting element has parallel front and rear faces and the leading face of the blade is formed in the longitudinal direction thereof in a staircase formation with the part thereof extending in the longitudinal direction being inclined whereby when the cutting elements are positioned on the parts thereof extending in the longitudinal direction, a leading surface of the cutting element presents a negative axial rake angle. In yet another alternative each cutting element has parallel front and rear faces, the rear face being secured to a leading side of said blade and said blade being inclined with respect to the longitudinal axis to provide said negative axial rake angle.

Advantageously a cutting edge and three protruding ridge elements, and preferably the cutting edge and each of the ridges has a rake angle in the range 0–40 degrees, advantageously 3–12 degrees and a land angle in the range 0–35 degrees, preferably 3–15 degrees.

Conveniently the cutting elements are each quadrilateral in cross-section, conveniently square. Preferably the cutting elements extend both in a radial and a longitudinal direction over the blade leading face.

Advantageously the ridges protrude from the recessed portion in the range 0.001–0.060 inches (0.025–1.5 mm) preferably 0.003–0.015 inches (0.076–0.38 mm).

Advantageously each cutting element is made from tungsten carbide having European ISO standard P10 to P60 hardness grade and with a cobalt content in the range 7%–20%.

Preferably each blade is located about the circumference of a tool body member and each blade is pivotally located to said body member.

According to a further aspect of this invention there is provided a rotatable milling tool for use downhole including a body having a longitudinal axis, a plurality of pivotally mounted blades circumferentially spaced around the body, slot means for receiving each blade in a contracted condition of the blade and means for radially extending each blade, the blade forms a surface faced toward the direction of rotation of the cutter. The blade further forms an upper and lower end. The blade surface provides a base for a plurality of cutting elements mounted to the surface of the blade. Each cutting element forms a cutting face with a lowermost radially extending cutting edge. The cutting face of the element forms at least a first lowermost protruding ridge and a second uppermost protruding ridge, the cutting face further forms curved surfaces leading up to each of the first and second ridges, the first and second ridges being radially disposed and longitudinally spaced one from the other on the cutting face of the element. In a downhole milling operation, swarf moves upwardly from the lowermost cutting edge of the element positioned at the lower end of the blade and is broken off when approaching the first protruding ridge along the curved surface leading up to the ridge formed on the cutter element. As the lower end of the blade wears during use, the cutting edge of the element moves past the first ridge towards the second uppermost ridge formed on the element. The swarf moves upwardly from the cutting edge along the curved surface toward the second ridge thereby continually breaking up the swarf to maintain maximum cutting efficiency of the cutter despite wear of the blade.

Preferably the surface of the blade extends in a generally radial direction across the intended direction of rotation of the tool and the cutting edges also extend generally radially.

According to another aspect of this invention there is provided a milling tool for use in energy exploration, the tool being connectable to a drilling string and rotatable about a longitudinal axis, the tool having a cutter comprising at least one radially disposed, longitudinally extending blade forming a surface faced toward the direction of rotation of the cutter. The blade further forms an upper and lower end. The blade surface provides a base for a plurality of cutting elements mounted to the surface of the blade. Each cutting element forms a cutting face with a lowermost radially extending cutting edge. The cutting face of the element forms at least a first lowermost protruding ridge and a second uppermost protruding ridge the cutting face further forms curved surfaces leading up to each of the first and second ridges, the first and second ridges being radially disposed and longitudinally spaced one from the other on the cutting face of the element. In a downhole milling operation, swarf moves upwardly from the lowermost cutting edge of the element positioned at the lower end of the blade and is broken off when approaching the first protruding ridge along the curved surfaces leading up to the ridge formed on the cutter element. As the lower end of the blade wears during use, the cutting edge of the element moves past the first ridge towards the second uppermost ridge formed in the element. The swarf moves upwardly from the cutting edge along the curved surface toward the second ridge thereby continually breaking up the swarf to maintain maximum cutting efficiency of the cutter despite wear of the blade.

The above noted objects and advantages of the present invention will be more fully understood upon a study of the following description in conjunction with the detailed drawings.

BRIEF DESCRIPTION OF THE DRAWINGS

The invention will now be described by way of example with reference to the accompanying drawings in which.

In the figures like reference numerals denote like parts.

DESCRIPTION OF THE PREFERRED EMBODIMENTS AND BEST MODE FOR CARRYING OUT THE INVENTION

Figure 1:
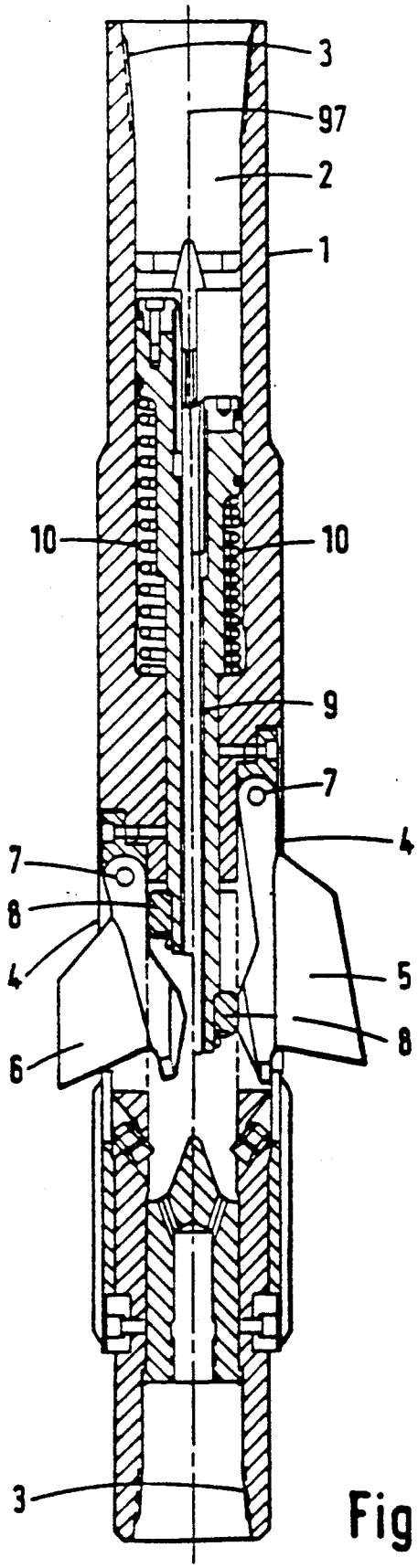
FIG. 1 shows a partial longitudinal cross-section of a rotatable milling tool incorporating the cutter of this invention.

The rotatable milling tool for use downhole shown in FIG. 1 has a circularly cross-section body 1 having axial passages 2 therethrough for the circulation of fluid and the upper and lower ends of the body each have a internal screw thread 3 for connecting the body to a drill string and other apparatus respectively. The body may have three to twelve, preferably six, equi-circumferentially spaced longitudinal slots 4 provided in the outer circumference thereof. Three axially long cutters 5 interspaced by three axially short cutters 6 are each mounted on a respective pivot 7 in each of the slots 4 and respective cam 8 carried by circulating fluid operated piston 9 acts on the cutters 5, 6 so that the cutter is pivotally radially movable away from the body 1 to a cutting position (the cutter 5 only being shown radially extended). The piston 9 is biassed by a compression spring 10. In operation the tool 1 is rotatable about a longitudinal axis 97.

Figure 2:
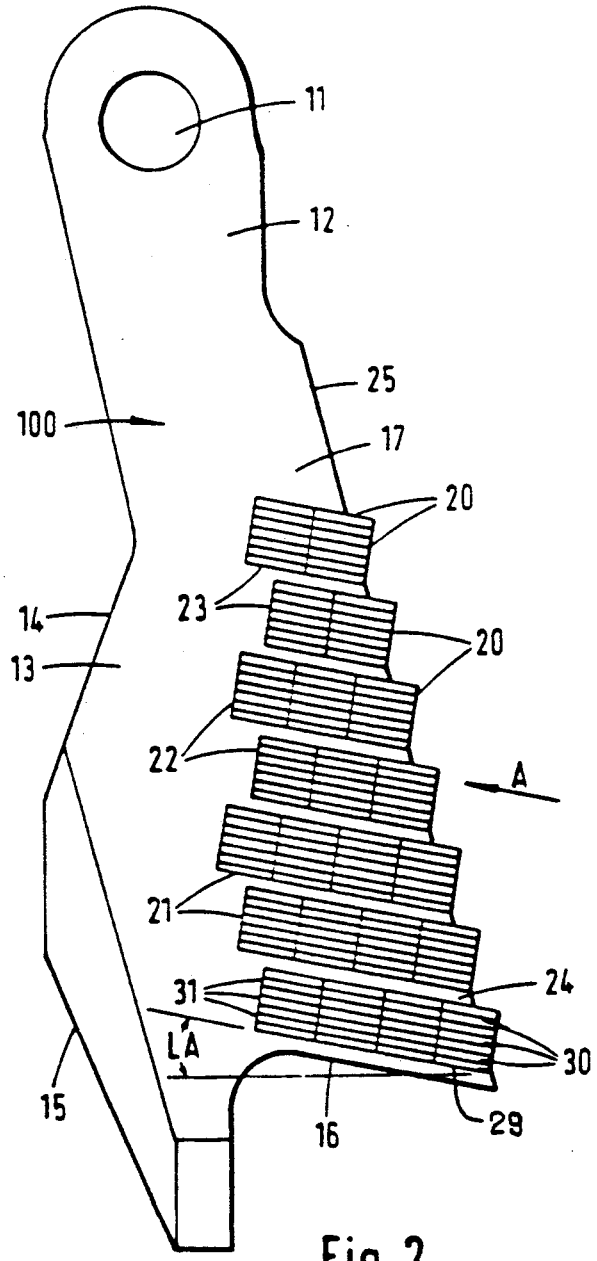
FIG. 2 shows a side view of a cutter accordance with this invention.

One of the cutters 5 is shown in detail in FIGS. 2, 3, 4 and 5A and has a longitudinally extending blade 100, the upper end (as shown in FIG. 2) being provided with a circular hole 11 through which the pivot 7 is located. The blade 100 has a necked portion 12 in which the hole 11 is situated which broadens out to a main portion 13, a radially inner side 14 along which cam 8 abrades linking to an approximately triangularly cross-sectioned rib 15. The lower part of the blade 100 has an L-shaped cutout to provide a lower, in use, edge 16.

Figure 3:
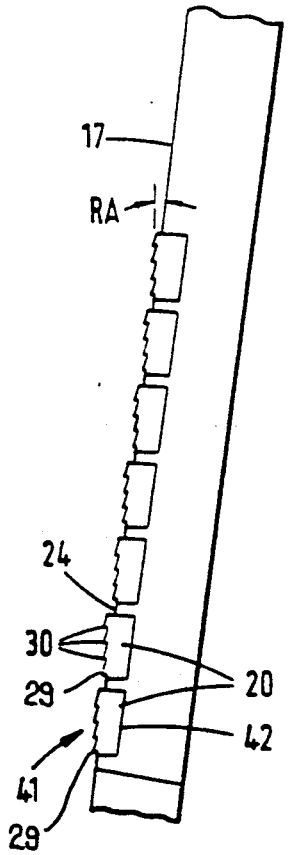
FIG. 3 shows a partial side view in the direction of arrow-headed line A of FIG. 2 of one embodiment of the invention.
Figure 4A:
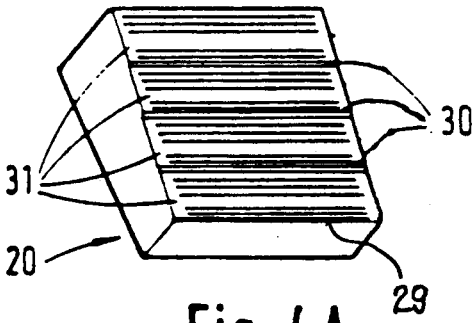
FIG. 4A shows a perspective view of a detail of the cutting element shown in FIG. 3, FIGS. 4B and 4C show mutually orthogonal views of the cutting element shown in FIG. 4A, FIGS. 5A, 5B and 5C each show further embodiments of the invention in which cutting elements are secured to a blade to provide a negative axial rake.
Figure 4B:
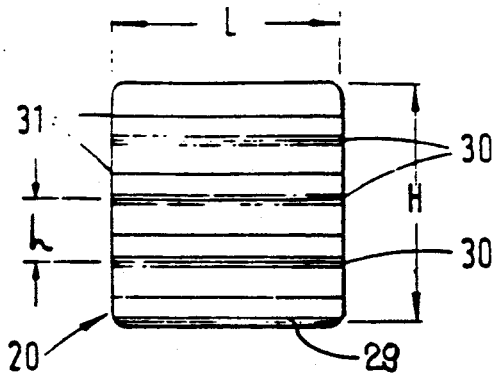
Figure 4C:
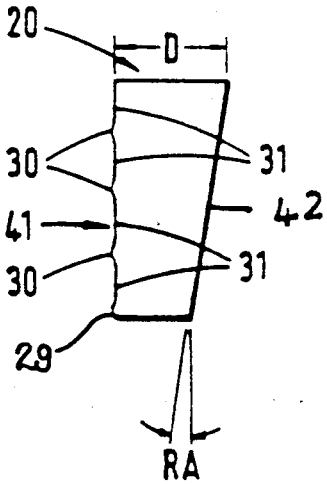

Located over a leading surface 17 of the blade, i.e. facing forwardly in the direction of rotation of the tool, is a plurality of cutting elements 20, each as shown in FIGS. 4A–4C, the elements being secured to the blade by any convenient means known per se such as by brazing, welding or soldering. The cutting elements are positioned in radial rows 21, 22, 23, the lower two rows 21 each comprising four cutting elements located in abutting relationship side by side to one another, row 22 comprising three elements abutting one another side by side. Each of the rows 21, 22, 23 is located in a longitudinal direction one above the other. In the embodiment of FIGS. 2, 3 and 4 the elements 20 are slightly spaced from one another in the longitudinal direction by a portion of blade 24. Each of the rows are staggered with respect to an adjacent row such that odd numbered rows starting from the lower edge 16 and extending upwardly in the longitudinal direction are located to align with one another and the even numbered rows are located to align with one another, the odd numbered rows being offset from the even numbered rows by about half the radial length of a cutting element, thereby forming a "brickwork" pattern. In the arrangement shown in FIG. 2 the element at the radial outermost end of each row is arranged to have the lower radial outer corner in alignment with a sloping edge 25 of the blade although it is to be understood that such a requirement is not necessary for the utility of the invention. It is also to be understood that it is not necessary, although highly desirable, to arrange the cutting elements in each row in abutting radial relationship to one another.

Each cutting element has a cutting edge 29 and a plurality of protruding ridges 30, each extending radially and each being longitudinally axially spaced from an adjacent edge, each ridge being inter-spaced between one another by a recessed portion 31. In the currently preferred embodiment a cutting edge 29 and three ridges 30 are provided. The cutting edge 29 and each of the ridges 30 adjacent elements 20 align with one another in a radial direction and each of the rows of cutting elements 20 are inclined relative to a line which is perpendicular to the longitudinal axis, i.e. have a lead attack angle LA which is in the range 1–15 degrees and preferably 10 degrees.

Figure 8A:
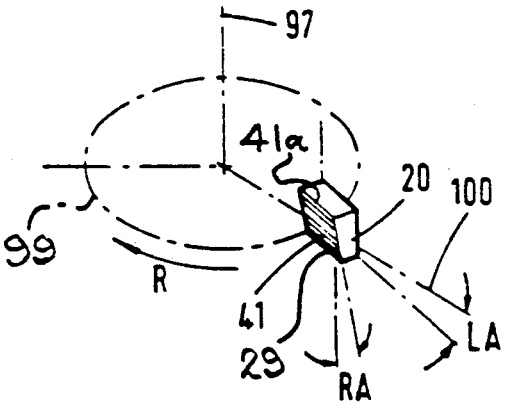
Figure 8B:
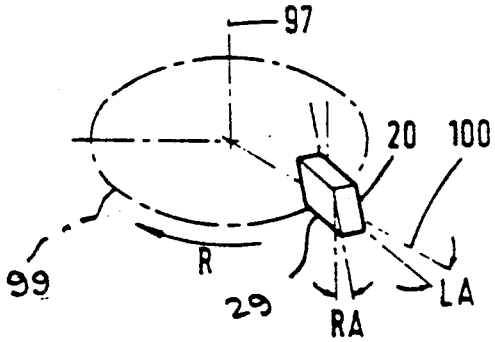

For a better understanding of terms used herein, reference will now be made to FIGS. 8A and 8B where the longitudinal axis 97 of the tool is taken as a reference and the direction of rotation of the tool is shown by arrow-headed line R, and a radius of the tool, perpendicular to axis 97, is shown by line 100. In FIG. 8A element 20 has a leading cutter face 41 arranged to be inclined downwardly and rearwardly with respect to the direction of rotation R and in relation to the longitudinal axis 97 to create a negative axial rake angle RA with respect to the plane of the longitudinal axis which angle is in the range 1–20 degrees and preferably in the range 7–10 degrees. In FIG. 8A the negative axial rake angle is provided by the cutting element having front and rear surfaces inclined with respect to one another whereas in FIG. 8B the front and rear surfaces of the cutting element are parallel and the element as a whole axially inclined. The provision of such a negative axial rake angle provides an improved cutting effect. A further improvement to the cutting effect is afforded by inclining the radially outer edge of the element 20 downwardly with respect to radius 100 to provide the aforementioned lead attack angle LA.

Negative rake angle refers to an angle of the cutting blade with respect to a relatively perpendicular surface and to the direction in which the blade moves across the surface. A zero rake angle is a blade that is exactly ninety degrees to or perpendicular to the surface.

FIG. 8A illustrates a negative rake angle (RA) of element 20. The upper edge 41*a* leads the cutting edge 29 as the element moves across (in direction R) the relatively perpendicular plane 99. As stated before, the negative axial rake angle is preferred in the range of 7–10 degrees.

A positive rake angle, for example, would have upper edge 41*a* lagging behind cutting edge 29 as the element 20 moves in direction R across surface or plane 99 (not shown).

It would be obvious to mount the cutters 20 such that there is no negative rake with respect to the longitudinal axis 97. In other words face 41 of cutter 20 may be substantially parallel with axis 97 without departing from the spirit of this invention. The negative rake angle (RA) is however preferred. Referring to FIG. 3, each of the cutting elements 20 has a leading cutting face 41 which incorporates the cutting edge 29 and ridges 30 and recessed portions 31 and a rear face 42 which abuts the blade, the front and rear surfaces being inclined with respect to one another to provide the front surface 41 with the negative axial rake angle RA. In the embodiment of FIG. 3 the elements 20 are located within slots formed in the leading face 17 of the blade and the slots are of constant depth in both longitudinal and radial directions, the negative axial rake angle being provided by the front and rear surfaces 41, 42 respectively of the cutting element 20 being inclined to one another.

Figure 7:
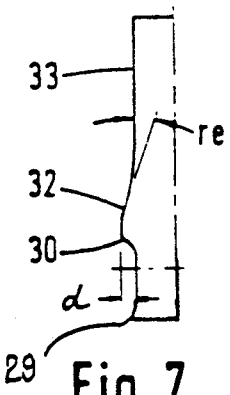
FIG. 7 shows an enlarged partial side view of the cutting element of this invention, and FIGS. 8A and 8B each show, in diagrammatic form, differing angles that may be provided to a cutting element.

One such cutting element 20, for example, is shown in FIGS. 4A–4C, each cutting element 20 having a square cross-section with a length L and height H of 0.375 inches (9.5 mm) and a depth D of 4.8 mm, the distance h between each of the ridges 30 being 0.094 inches (2.3 mm). As shown in FIG. 7, the cutting edge 29 and each of the ridges 30 has an axial rake angle $\alpha$re in the range 0–40 degrees, preferably 5–12 degrees, what is known as land angle is in the range 0–35 degrees preferably 3–15 degrees. The ridges 30 protrude from the recessed portion by distance d in the range 0.001–0.060 inches (0.025–1.5 mm), preferably 0.003–0.015 inches (0.076–0.38 mm). Thus the recess 31 has a negative rake angle portion 32 and a further, curved portion 33 extending toward an adjacent ridge 30.

Although the length and height of the elements 20 of the preferred embodiment are the same it is to be understood that this is not necessary for the utility of the invention. The cutting elements, for example, are each made of tungsten carbide having European I.S.O. standard P10 to P60 hardness grade and with a cobalt content in the range 7%–20%, such as HS6 grade tungsten carbide of Cutting & Wear Resistant Developments Ltd., Rotherham, England.

It is to be further understood that the cutter elements 20 may be utilized in a cutter other than a milling tool to mill pipe casing. For example, the cutter 20 may be used in a milling machine or lathe to break up a tailing swarf from a work piece.

In the use of the tool, when it is lowered into a drill hole on a drill string, the blades 5 are recessed into their respective slots 4. When the tool reaches the position where cutting is required to commence, as fluid is pumped down the drill string to which the tool 1 is attached so as to activate piston 9 and cam 8 to move the blades 5 pivotally radially outwardly against the bias of spring 10 to a cutting position. The tool 1 is then rotated for cutting by the leading surface 41 of the cutting elements to commence. The depth d and distance h of the cutting edge 29 and the ridges 30 in combination with the shape of the recessed portion 31 is arranged to provide a generally c-shaped swarf cutting having a thickness of 0.15 inches to 0.020 inches (0.38 mm to 0.05 mm).

Figure 5A:
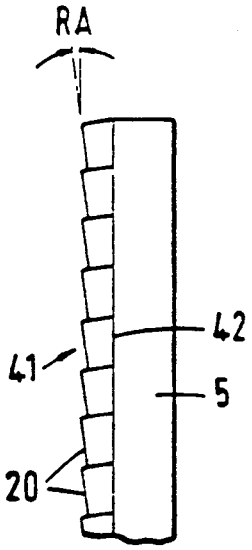
Figure 5B:
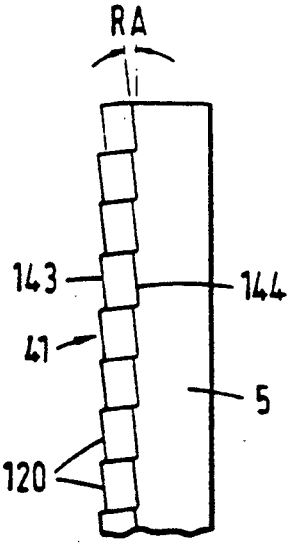
Figure 5C:
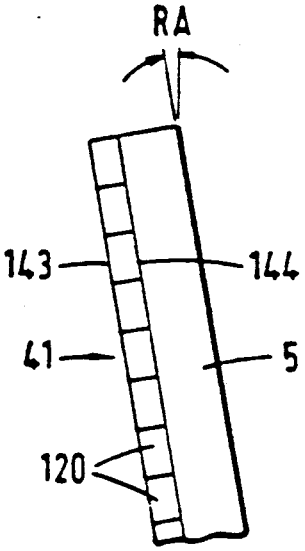
Figure 6A:
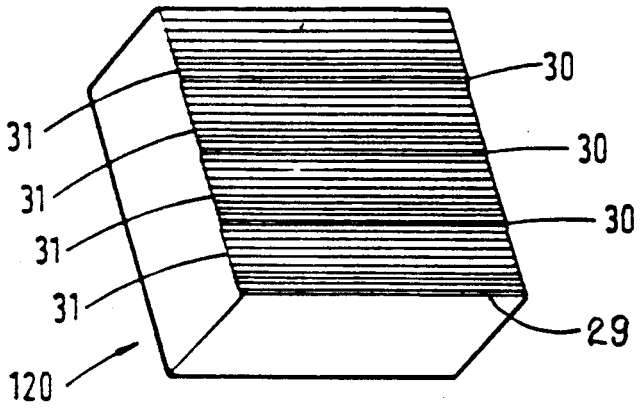
FIGS. 6A–6C show details of a cutting element of the type used in the embodiments of FIGS. 5B and 5C.
Figure 6B:
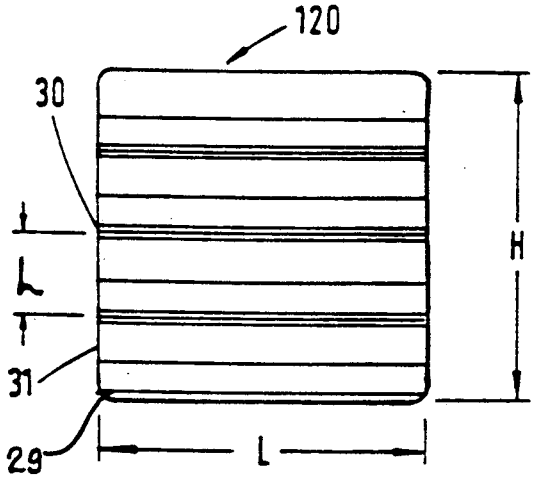
Figure 6C:
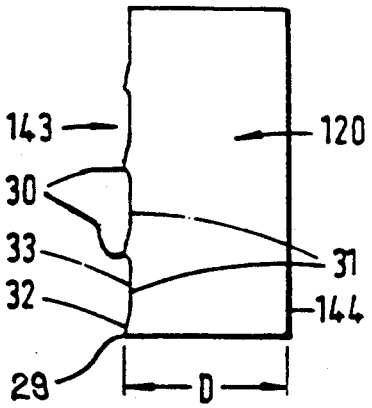

The invention has so far been described in relation to one embodiment but other embodiments of the invention are envisioned that will be self-evident to those skilled in the art. The blade shown in FIG. 5A has cutting elements 20 disposed radially and axially adjacent to one another so that the portions of blade 24 between each cutting element are no longer present. The cutting elements 20 used are similar to those shown in FIGS. 4A–4C so that the blades 5 have parallel leading and trailing faces and the negative axial rake angle RA is provided by the inclined front and rear faces 41, 42 respectively of the elements 20. The blade shown in FIG. 5B has cutting elements 120 with parallel front and rear surfaces 143, 144 respectively so that the leading surface 17 of the blade 5 has a staircase formation on the surface thereof to provide the negative axial rake angle RA. In FIG. 5C the cutting element 120 is again used but the negative axial rake angle RA is provided by inclining the blade relative to the axis 97. An embodiment of the cutting elements 120 is shown in FIGS. 6A–6C.

Although the cutter of this invention has been described in connection with a tool having pivotal blades it is to be understood that the cutter may also be used with a tool having fixed blades such as a mill cutter.

Although the cutting edge and the ridges are described in the exemplary embodiment more or fewer ridges could be provided in dependence upon individual requirements. Also, although the cutting elements in the preferred embodiment have a quadrilateral cross section in the direction facing rotation of the tool, other shapes could be used such as triangular, hexagonal, polygonal, etc.

The present invention has the advantages that if a cutting edge becomes worn and passes beyond the next ridge a new ridge is immediately exposed to break up the swarf as the swarf approaches the next ridge, by providing the cutting elements on the leading surface of the blade in a staggered (brickwork) fashion, a continuous cutting edge is provided in a radial direction of the blade. The cutter of this invention therefore provides a sharp cutting edge and multiple ridges which are continuously exposed to provide efficient milling, the swarf cuttings (chips) that are cut by the tool are of a consistently small size and shape which results in efficient hole cleaning and as a result the rate of penetration of the tool embodying the cutter is rendered more consistent.

Although the present invention has been described with reference to preferred embodiments, those skilled in the art will recognize that changes may be made in form and detail without departing from the spirit and scope of the invention.

What is claimed is:

1. A cutter for a downhole milling tool which tool is rotatable about a longitudinal axis, said cutter comprising a blade having a cutting surface formed by a plurality of cutting elements, characterized by each cutting element having a face oriented with respect to a cylindrical work piece, the lower end of the face forming a cutting edge which is adapted to engage the top of the work piece and cut swarfs therefrom, said cutting edge further adapted to move upwardly along the face as it wears away, and a plurality of means located on the face for contacting and breaking the swarf as the cutting edge moves along the work piece.

2. The invention of claim 1 wherein said plurality of means for contacting and breaking the swarf comprises a plurality of protrusions formed on the surface.

3. The invention of claim 2 wherein said protrusions comprise a plurality of ridges longitudinally spaced on said face and substantially parallel with said cutting edge.

4. A cutter as claimed in claim 1 wherein the blade surface extends in a generally radial direction across the intended direction of rotation of the tool and the cutting edge of said cutter element also extend generally radially.

5. A cutter as claimed in claim 1 wherein each cutting element is a discrete part, each of which is mounted to the cutting blade surface by brazing.

6. A cutter as claimed in claim 1 wherein the cutting elements of odd numbered rows extending longitudinally are in line and even numbered rows extending longitudinally are in line and the even numbered rows are offset in a radial direction by about half the radial length of a cutting element from the odd numbered rows.

7. A cutter as claimed in claim 1 wherein each cutting element is arranged to produce a negative axial rake angle with respect to the plane of the longitudinal axis, which angle is in the range 1–20 degrees.

8. A cutter as claimed in claim 7 wherein each cutting element is arranged to produce a negative axial rake angle with respect to the plane of the longitudinal axis, which angle is in the range 7–10 degrees.

9. A cutter as claimed in claim 1 wherein each of the cutting elements is secured over a planar leading surface of the blade and each element has a front cutting face which is inclined with respect to the rear surface thereof, said rear surface abutting the blade surface so that the front cutting surface is provided with said negative axial rake angle.

10. A cutter as claimed in claim 1 wherein three protruding ridges extend from said cutting face of said cutter element.

11. A cutter as claimed in claim 1 wherein the cutting elements are each quadrilateral in cross-section.

12. A cutter as claimed in claim 1 wherein the cutting elements extend both in a radial and longitudinal direction over the blade surface.

13. A cutter as claimed in claim 1 wherein each cutting element is made from tungsten carbide having European ISO standard P10 to P60 hardness grade and with a cobalt content in the range 7%–20%.

14. A cutter as claimed in claim 1 wherein each blade is located about the circumference of a tool body member and each blade is fixed to said body member.

15. A cutter for a downhole milling or cutting tool which tool is rotatable about a longitudinal axis, said cutter comprising a blade having a cutting surface formed by a plurality of cutting elements, a lower generally radial edge of said cutting surface being adapted to cut a workpiece characterized by each cutting element having a plurality of protrusions each being longitudinally axially spaced from one another and interspaced by a recessed portion, each protrusion successively being adapted to be in contact with said workpiece as the cutting surface wears away longitudinally upwardly, and swarf from said workpiece is adapted to move upwardly from the lowermost cutting edge along said recessed portion to be subsequently broken off upon approaching the next uppermost protrusion.

* * * * *